United States Patent [19]

Krieger

[11] Patent Number: 4,862,663

[45] Date of Patent: Sep. 5, 1989

[54] THERMALLY INSULATED SUSPENSION CEILING

[76] Inventor: Steve Krieger, 150 S. Atlanta St., Roswell, Ga. 30075

[21] Appl. No.: 261,623

[22] Filed: Oct. 24, 1988

[51] Int. Cl.[4] ..... E04B 5/52

[52] U.S. Cl. ..... 52/309.7; 52/309.16; 52/484; 52/485

[58] Field of Search ..... 52/309.7, 309.16, 484, 52/485, 486, 585, 586, 309.2, 309.13, 309.14

[56] References Cited

U.S. PATENT DOCUMENTS

| | | | |
|---|---|---|---|
| Re. 31,528 | 3/1984 | Mieyal | 52/484 |
| 695,594 | 3/1902 | Yarnall | 52/585 |
| 2,065,796 | 12/1936 | Davis | 52/485 |
| 3,736,012 | 5/1973 | Boylan | 52/488 |
| 3,898,782 | 8/1975 | Donato | 52/488 |
| 3,979,867 | 9/1976 | Sowinski | 52/309.7 |
| 4,272,928 | 6/1981 | Schluter | 52/232 |
| 4,736,564 | 4/1988 | Gailey | 52/488 |
| 4,744,188 | 5/1988 | Ahren | 52/488 |
| 4,774,794 | 10/1988 | Grieb | 52/309.7 |

FOREIGN PATENT DOCUMENTS

| | | | |
|---|---|---|---|
| 2332778 | 1/1974 | Fed. Rep. of Germany | 52/309.7 |
| 1175977 | 11/1958 | France | 52/485 |

*Primary Examiner*—Carl D. Friedman
*Assistant Examiner*—Caroline D. Dennison
*Attorney, Agent, or Firm*—Thomas & Kennedy

[57] ABSTRACT

A suspension ceiling for a walk-in cooler comprises a set of panels that have a thermally insulated foam core in which a rigid support channel is embedded so as to extend from one panel side to another. Hangers are included that have a bar sized to be inserted into the ends of the support channels of adjacent panels from which bars suspension rods or wires extend.

10 Claims, 2 Drawing Sheets

19
30
36
38
19
30

19
24
23
24
28
32
30
37
38
36
37

30
31
25
27
19
27
26
24
23
24

THERMALLY INSULATED SUSPENSION CEILING

TECHNICAL FIELD

This invention relates to ceilings of the type suspended beneath a roof or other ceiling, and particularly to thermally insulated suspension ceilings such as those of walk-in coolers.

BACKGROUND OF THE INVENTION

It is often desirable to suspend ceilings from overhead structures such as roofs or higher floors in order to provide a smaller space to conserve the costs of space heating and cooling and for aesthetics. For example, the basements of homes commonly have a multi-paneled ceiling suspending from overhead joists. In other cases island ceilings are suspended beneath higher ceilings and roofs for purely aesthetic reasons. Commercial buildings, such as retail stores, also commonly have suspended ceilings. Often these form the top of a refrigerated space such as a walk-in cooler in which cases the ceilings are insulated. Exemplary of such suspended ceilings are those shown in U.S. Pat. Nos. 3,736,012, 3,898,782, 4,272,928, 4,736,564, 4,744,188 and Re. 31,528.

Suspended ceilings are commonly comprised of a grid like frame which is suspended by a set of wires from an overhead structure such as the roof of a building. The grid like frame has lower flanges which are oriented horizontally upon which panels may be individually set and supported. Thermally insulated ceilings however are not well-suited for support from a grid like frame. This is because they are constructed to be interfitted sequentially in tongue and groove fashion so that they are well insulated at their junctures. Nevertheless, thermally insulated panels, which normally have an expanded foam polyurethane or polystyrene core that is overlaid by metal sheets, must be centrally supported to prevent sagging.

Heretofore, thermally insulated, multi-panel suspension ceilings have been suspended by the means of clips sandwiched between the tongues and grooves of adjacent panels mated together in tongue and groove fashion. Exemplary of such is the clip 10 shown in FIG. 2 of the drawing which is shown mounted uprightly flushly over the tongue 11 of an insulated ceiling panel 12. An unshown wire extends upwardly from the upper tab of the clip inserts. After the clip has been placed as shown in FIG. 2 a mating panel formed with a groove is placed in abutment with the tongue 11 and with its surrounding shoulders and over the clip.

The just described device and method of suspending ceilings, however, has long been beset with problems. Principal among such is the difficulty normally encountered by workers in assembling and hanging the ceilings. Without a grid frame available, and with simply the provision of independently suspended clips, panel movements encountered during the erection process easily cause the interfitted tongues and grooves of adjacent panels to become dislodged from the clip and to fall. Furthermore, even when erection has been completed the ceiling still remains susceptible to dislodgement in the event an object accidentally strikes the ceiling. This in turn can create a cascade of falling panels.

Accordingly, it is seen that a need has long existed for the provision of a suspension ceiling of the thermally insulated type which may be easily and surely erected and maintained by relatively inexpensive means. It is to the provision of such therefore that the present invention is primarily directed.

SUMMARY OF THE INVENTION

In one form of the invention a ceiling for a walk-in cooler or the like comprises a plurality of panels that have a thermally insulated foam core in which a rigid hollow support member is embedded that extends from one panel side to another. The ceiling also has a plurality of hangers that have bars sized to be inserted into the ends of the support channels of adjacent panels from which bars suspension rods extend.

In another preferred form of the invention a ceiling for a walk-in cooler comprises a row of panels having thermally insulated foam cores. The panels are consecutively interfitted in tongue and groove fashion by the mating of tongues and grooves formed on opposite ends of the panel foam core. A segmented support channel extends through the row of panels embedded in the panel foam cores. The support channel is segmented adjacent the interface of tongues and grooves of adjacent panels. Inverted T-shaped hangers support the ends of adjacent support channel segments.

DETAILED DESCRIPTION

Figure 1:
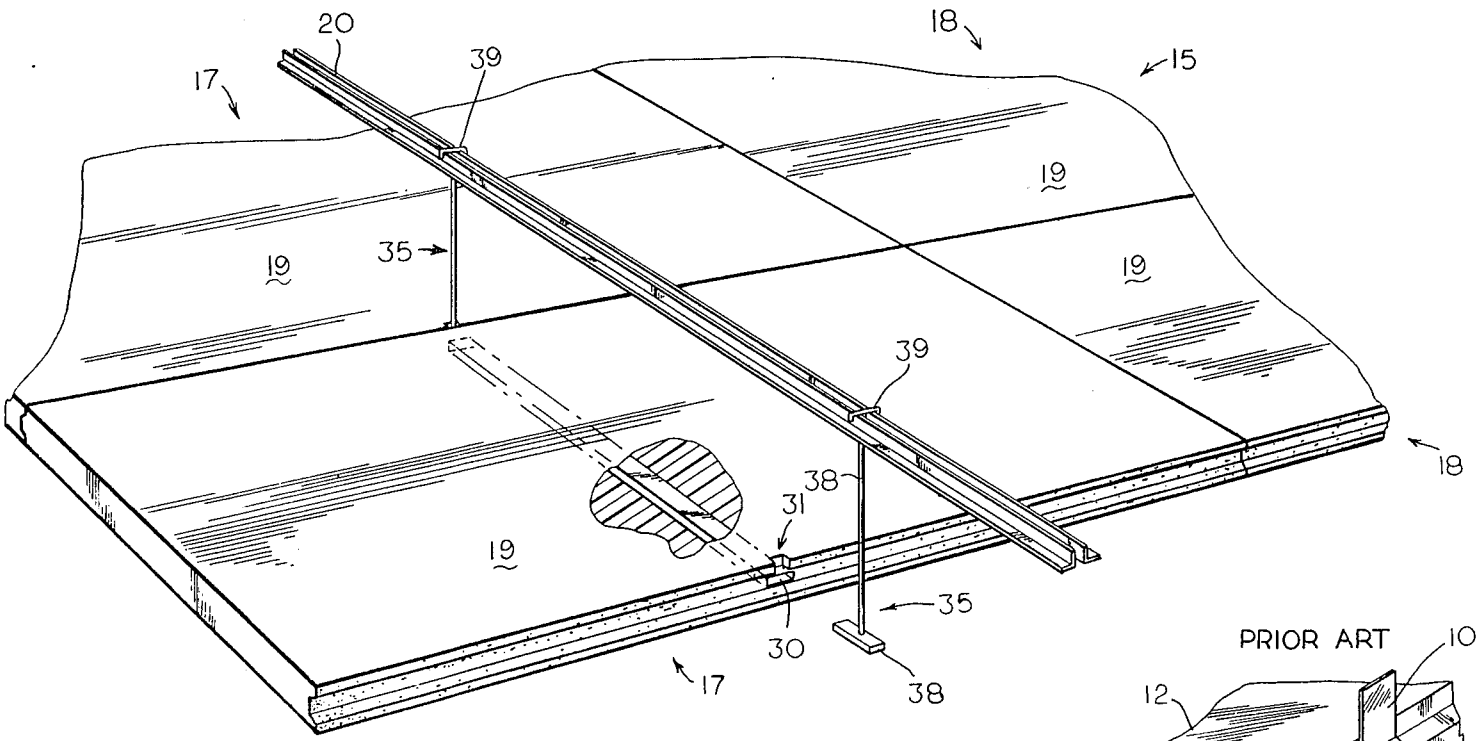
FIG. 1 is a perspective view of a portion of a thermally insulated suspension ceiling which embodies principles of the invention in a preferred form.
Figure 2:
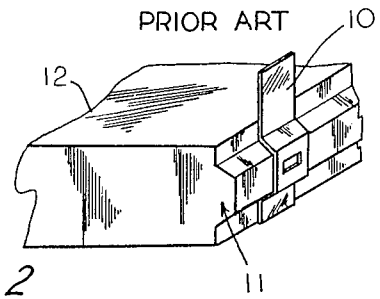
FIG. 2 is a perspective view of an end portion of one panel of the ceiling shown in FIG. 1 which shows a clip attached thereto as heretofore done in ceilings of the prior art, as herein previously described.
Figures 3, 4:
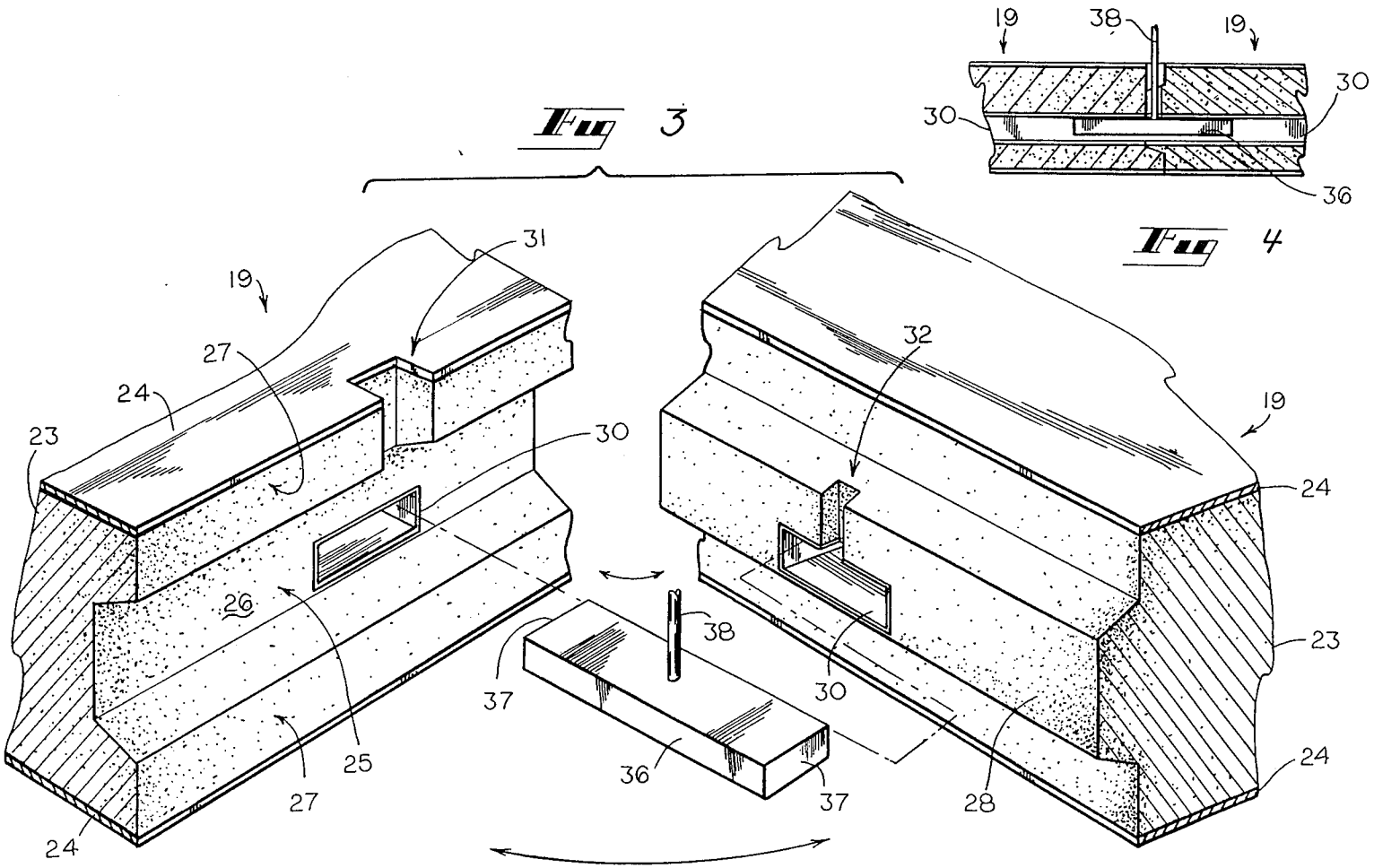
FIG. 3 is an exploded view, in perspective, of end portions of adjacent ceiling panels together with a hanger located therebetween.
FIG. 4 is a cross-sectional view of the ceiling portions illustrated in FIG. 3 shown in an interfitted, assembled configuration.

With reference next to FIGS. 1, 3 and 4 there is shown a ceiling 15 which embodies principles of the present invention. The portion of the ceiling shown in FIG. 1 is seen to be comprised of two rows 17 and 18 of identical panels 19. Each row is suspended beneath a beam 20, only one of which is illustrated here. The panels 19 of a single row are snugly interfitted in tongue and groove fashion while the panels of adjacent rows are placed flushly together along a common plane.

Each of the ceiling panels 19 is of basically conventional structure and has an expanded foam polystyrene or polyurethane core 23 whose major surfaces are overlaid within thin sheets of metal 24 for structural integrity. One end of each panel is formed with a groove or trough, indicated generally at 25, that has a floor 26 which is located between two shoulders 27. The opposite end of each panel is formed with a protruding tongue 28 which is sized and shaped to mate or interfit snugly within the groove of an adjacent panel.

Each of the panels 19 is further seen here to have a tubular, rigid, support channel or channel segment embedded centrally within the expanded foam core in a position so that its opposite ends terminate adjacent the trough floor 26 and the tongue 28, respectively. Alternatively, an inverted U-shaped channel may be used. At least one of the shoulders 27 that border the groove 25 is formed with a notch 31 above the end of the channel 30. Similarly, each tongue 28 is provided with a notch 32 over the open end of the channel 30. Here, the channel itself is similarly notched.

A hanger 35 is provided at the juncture of adjacent panels in each row. Each hanger comprises a bar 36 which is sized to have its opposite ends 37 inserted into the open ends of the embedded channel 30. The hanger also has a rod 38 that projects upwardly from the upper surface of the bar to a hook 39 which is sized and shaped to be placed over the beams 20. Alternatively, a wire may be used which is herein considered as an equivalent. Once assembled to the panels the rod 38 passes through the notches 31 and 32, as best shown in FIG. 4.

A suspension ceiling of the type just described may be relatively easily and surely erected in a time efficient manner. This is preferably done by placing a hanger bar 36 in one open end of a channel 30 of one panel 19 with the hanger rod 38 passing through the adjacent notch. With that panel now suspended the next panel may be interfitted in tongue and groove fashion with the bar jutting out of the already suspended bar passing freely into its support channel. This procedure is continued until the row is completely erected. The completed row will then have a support channel, segmented at the junction of mated panels, which extends the length of the row.

The just described procedure is easy to follow with minimal risk incurred of panels becoming separated from a hanger and from falling either during installation or afterwards. Upon completion no grid work or hanger bars are visible from beneath the ceiling and yet a snug, thermally insulated interfitted arrangement of panels is provided.

It should be understood that the just described embodiment merely illustrates principles of the present invention in a preferred form. Many modifications, additions and deletions, other than those expressly suggested, may be made without departure from the spirit and scope of the invention as set forth in the following claims.

I claim:

1. A suspension ceiling for a walk-in cooler or the like comprising a plurality of panels with each panel having a thermally insulated foam core a hollow rigid support member embedded in said core and extending from one panel side to another panel side, and a plurality of hangers with each hanger having a bar sized to be inserted into the ends of said support members of adjacent panels thereby interconnecting the support members and a suspension rod extending from the bar.

2. The ceiling of claim 1 wherein the ends of said suspension rods located distally of said bars are provided with hooks adapted to be hooked over ancillary beams or the like.

3. The ceiling of claim 1 wherein one end of each of said panels is formed with a groove located between two shoulders and the opposite end is formed with a tongue, and wherein adjacent panels are snugly mated in tongue and groove fashion.

4. The ceiling of claim 3 wherein said each of said support members extends substantially from the surface of said groove to the surface of said tongue.

5. The ceiling of claim 3 wherein each of said panel tongues and one of said panel shoulders are formed with a notch through which the suspension rods may extend.

6. The ceiling of claim 1 wherein each of said rigid support members is tubular.

7. A suspension ceiling for a walk-in cooler or the like comprising a row of panels having thermally insulative foam cores, said panels being consecutively interfitted in tongue and groove fashion by the mating of tongues and grooves formed on opposed ends of each panel foam core, and a support member extending through said row of panels embedded in the panel foam cores, said support member comprising a plurality of support member segments interconnected adjacent the interface of mated tongues and grooves of adjacent panels, and a generally inverted T-shaped hanger interconnecting and supporting the ends of adjacent support member segments.

8. The ceiling of claim 7 wherein said inverted T-shaped hangers have hook means for hooking to an ancillary beam or the like that traverses the ceiling.

9. The ceiling of claim 7 wherein said each of said panel tongues is formed with a notch through which one of said hangers extends.

10. The ceiling of claim 9 wherein each of said panel grooves is bordered by a pair of shoulders, and wherein one of said shoulders is formed with a notch through which one of said hangers extends.

* * * * *